US008365968B2

(12) United States Patent
Yoon

(10) Patent No.: US 8,365,968 B2
(45) Date of Patent: Feb. 5, 2013

(54) CAP OF TUBE CONTAINER HAVING AUTOMATIC SEALING STRUCTURE

(75) Inventor: Hyun-Son Yoon, Incheon (KR)

(73) Assignee: Morris Corporation, Incheon (KR)

( * ) Notice: Subject to any disclaimer, the term of this patent is extended or adjusted under 35 U.S.C. 154(b) by 245 days.

(21) Appl. No.: 12/980,017

(22) Filed: Dec. 28, 2010

(65) Prior Publication Data

US 2012/0145752 A1 Jun. 14, 2012

(30) Foreign Application Priority Data

Dec. 10, 2010 (KR) ..... 10-2010-0126465

(51) Int. Cl.
*B67D 3/02* (2006.01)
*B67D 3/00* (2006.01)

(52) U.S. Cl. ..... 222/507; 222/513; 401/109

(58) Field of Classification Search ..... 222/182, 222/491, 494, 496, 497, 505–507, 513–517; 401/107, 109, 110
See application file for complete search history.

(56) References Cited

U.S. PATENT DOCUMENTS

| | | | | |
|---|---|---|---|---|
| 2,695,737 | A * | 11/1954 | Schlicksupp | 222/513 |
| 5,919,159 | A | 7/1999 | Lilley et al. | |
| 7,220,073 | B2 * | 5/2007 | Yoon | 401/108 |
| 2009/0142124 | A1 * | 6/2009 | Dylkiewicz et al. | 401/108 |

FOREIGN PATENT DOCUMENTS

KR 1020090112372 10/2009

* cited by examiner

*Primary Examiner* — Kevin P Shaver
*Assistant Examiner* — Charles P Cheyney
(74) *Attorney, Agent, or Firm* — Hyunho Park

(57) ABSTRACT

A cap of a tube container having an automatic sealing structure, which more reliably performs an airtight function, prevents liquid ingredients in a nozzle from drying, safely protects the nozzle in a physical way, prevents gel-phased medical ingredients from being in contact with the outside air to the maximum extent possible, thus allowing the medical ingredients to be preserved for a longer period of time, and which is constructed so that the cap is integrated with the container, thus eliminating the risk of loss resulting from the separation. A cone which is secured by each locking protrusion inserted into a guide slit is inserted into a body as the locking protrusion moves, so that a nozzle hole is opened by an anti-drying unit and contents are discharged through an ejected nozzle.

7 Claims, 10 Drawing Sheets

CAP OF TUBE CONTAINER HAVING AUTOMATIC SEALING STRUCTURE

PRIORITY

This application claims priority under 35 U.S.C. §119(a) to an application filed in the Korean Intellectual Property Office on Dec. 10, 2010 and assigned Korean Patent Application No. 10-2010-0126465, the contents of which are incorporated herein by reference.

BACKGROUND OF THE INVENTION

1. Field of the Invention

The present invention relates generally to a cap of a tube container having an automatic sealing structure and, more particularly, to a cap of a tube container having an automatic sealing structure, which is intended to discharge liquid contents from the tube container only when a shutter of a discharge port is opened.

2. Description of the Related Art

In order to prevent contents from decomposing, a liquid medicine container must be constructed so that a discharge port as well as contents is isolated from the outside and is air-tightly sealed.

However, the sealing ability of a medicine container having a general tube shape, such as an ointment container, is considerably low, and the container is constructed so that a cap is separable from the container. Thus, when the cap corresponding to the container is lost, there is no means for sealing contents of the container, so that the contents cannot continue to be preserved.

In order to solve the problem, as shown in FIG. 1, U.S. Pat. No. 5,919,159 has been proposed, which is entitled 'a medical injection system and method'. It is constructed so that a housing includes a nozzle assembly having an ampule chamber for holding medicine, and medicine is injected from the nozzle assembly by axial movement. However, it is problematic in that it is opened or closed by hand, and besides, there is no construction for pressing a discharge port, so that the ability to seal off the medicine is poor.

Further, as shown in FIG. 2, Korean Patent Laid-Open Publication No. 10-2009-0112372 has been proposed, which is entitled 'an eye drop container opened or closed by leftward or rightward rotation of an outer cap'. The container is constructed so that a discharge port is opened or closed by rotating the outer cap, and the container is opened or closed not by opening or closing the outer cap but by rotating the outer cap without removing the outer cap from an inner cap. However, the method of opening or closing the container is similar to a manual operating method because the container is opened or closed by continuously rotating the outer cap.

SUMMARY OF THE INVENTION

Accordingly, the present invention has been made keeping in mind the above problems occurring in the prior art, and an object of the present invention is to provide a cap of a tube container having an automatic sealing structure, which is constructed so that a nozzle for discharging medicine is ejected or retracted in a non-contact manner by an anti-drying unit.

In order to accomplish the above object, the present invention provides a cap of a tube container having an automatic sealing structure, including a cone having a shape of a hollow pipe and having a nozzle hole formed in a first end of the cone to permit a nozzle to move in and out, an insert hole formed in a second end of the cone, and a pair of locking protrusions provided on opposite sides of an outer surface of the cone and adjacent to the insert hole; a body including a cap part comprising an integrated body which has on a first end thereof an insert hole to permit insertion of the cone, and has on a second end thereof a bottom, a support pipe extending from a center of the bottom, passing through an interior of the cap part and protruding to an outside of the cap part, and a guide slit formed at a position corresponding to each of the locking protrusions and movably restraining the locking protrusion; a tube containing contents, and having on an injection port for discharging the contents a screw that engages with a thread provided on an end of the support pipe; and an anti-drying unit interposed between the body and the cone to air-tightly close the nozzle hole of the cone which moves forwards and backwards relative to the body.

Further, the cone, which is secured by each of the locking protrusions inserted into the guide slit, may be inserted into the body as the locking protrusion moves, so that the nozzle hole is opened by the anti-drying unit and the contents are discharged through the ejected nozzle.

Further, support rings may be provided, respectively, on an outer surface of an end of the support pipe and an inner surface of an end of the nozzle so that the support pipe is firmly secured to the nozzle.

Further, the guide slit formed in a side surface of the cap part may include a locking part provided on a position of the guide slit adjacent to the insert hole of the cap part, and locking the locking protrusion under action of elastic force of the spring; an inclined part extending downwards from a hole which extends downwards from the locking part in a vertical direction in such a way as to have an inclination angle; an end formed at an end position of a hole which extends downwards from the inclined part in the vertical direction, forms a horizontal part, and then extends upwards in the vertical direction, and locking the locking protrusion under action of elastic force of the spring; and a locking step comprising a free end formed by the hole which extends downwards from the inclined part in the vertical direction, forms the horizontal part, and then extends upwards in the vertical direction.

The tube may further include a straw which extends from the injection port to be inserted into the support pipe and thus transmit the contents from the injection port to the nozzle.

Further, the nozzle may include a cut slit which is formed in a center of a curved surface of the nozzle in a shape of a straight line so as to discharge the contents, the cut slit being closed again by a restoring force of the nozzle made of an elastic material after the contents have been discharged.

Further, push protrusions may be provided on opposite sides of the cut slit on the curved surface of the nozzle, so that both the push protrusions are subjected to pressure by an inner wall of the holder when the nozzle is accommodated in the anti-drying unit, thus more water-tightly closing the cut slit.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a cap of a tube container having an automatic sealing structure according to an embodiment of the present invention will be described in detail with reference to the accompanying drawings.

Figure 1:
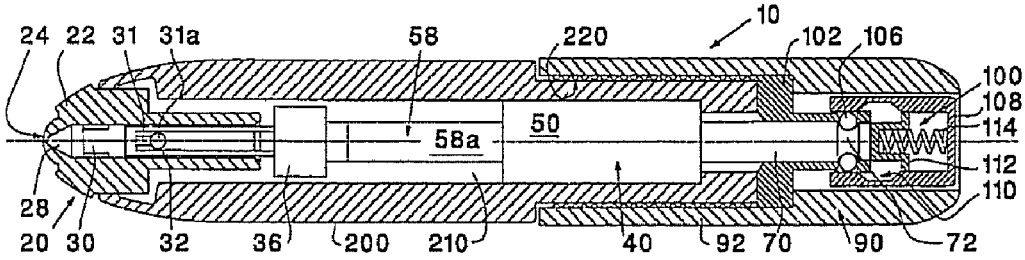
FIG. 1 is a sectional view showing a conventional medical injectionn system and method.
Figure 2:
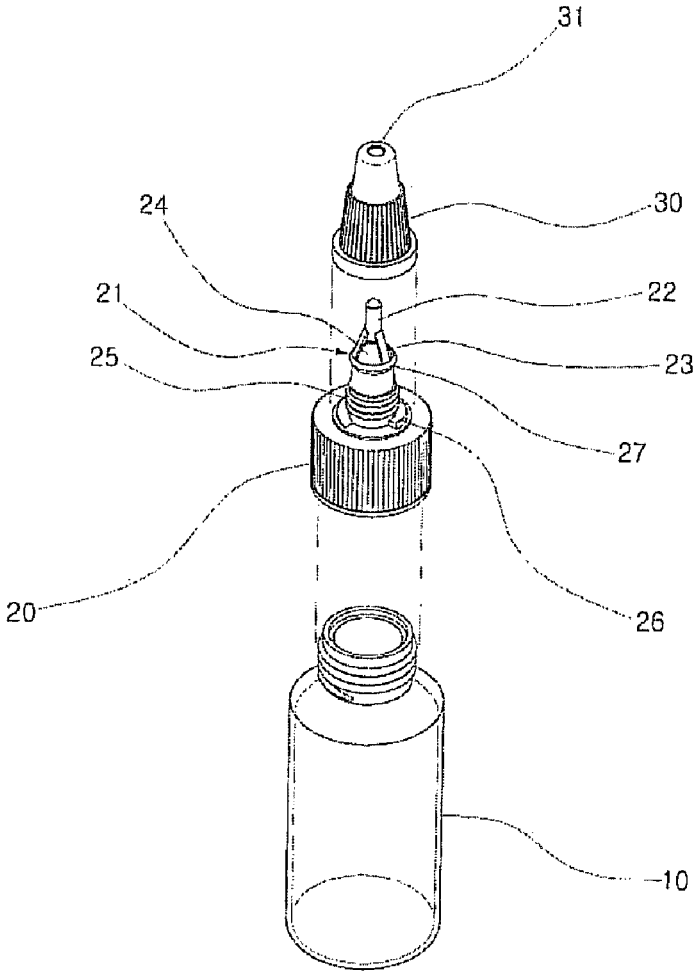
FIG. 2 is an exploded perspective view showing a conventional eye drop container.
Figure 3:
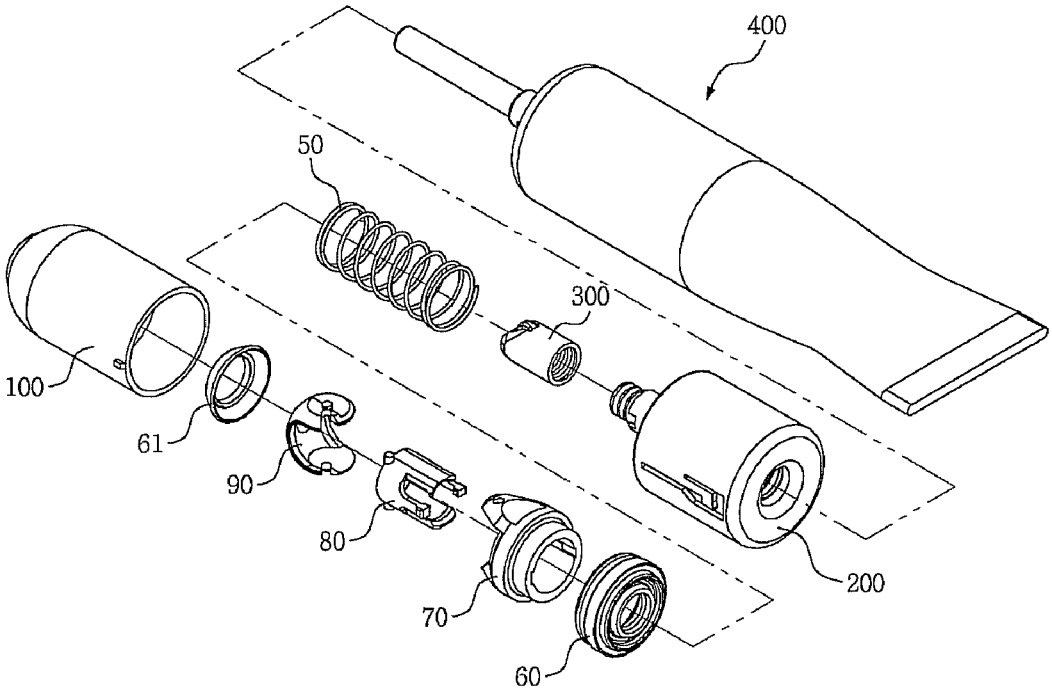
FIG. 3 is an exploded perspective view showing a cap of a tube container having an automatic sealing structure, according to an embodiment of the present invention.
Figure 4:
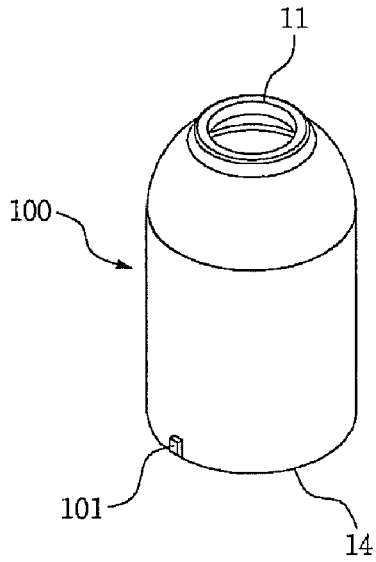
FIG. 4 is a perspective view showing a cone of FIG. 3.

FIG. 3 is an exploded perspective view showing a cap of a tube container having an automatic sealing structure, according to an embodiment of the present invention, and FIG. 4 is a perspective view showing a cone of FIG. 3.

Figure 5:
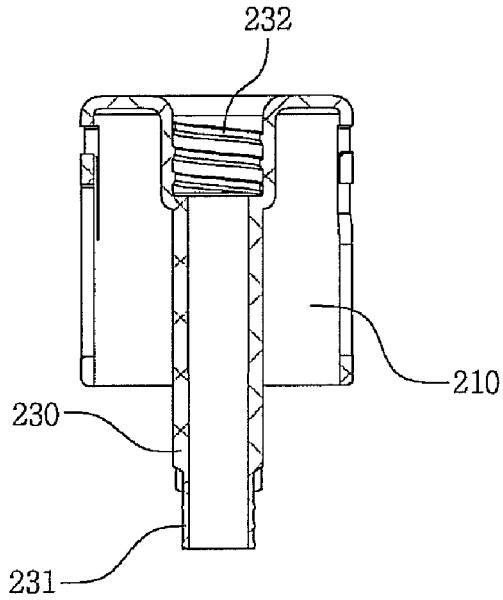
FIG. 5 is a sectional view showing a body of FIG. 3.
Figure 6:
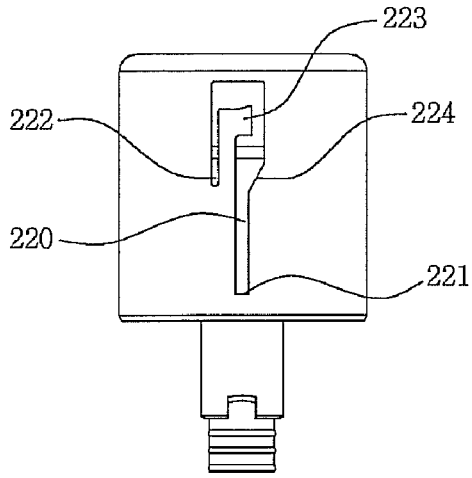
FIG. 6 is a side view showing the body of FIG. 5.

Further, FIG. 5 is a sectional view showing a body of FIG. 3, and FIG. 6 is a side view showing the body of FIG. 5.

Figure 7:
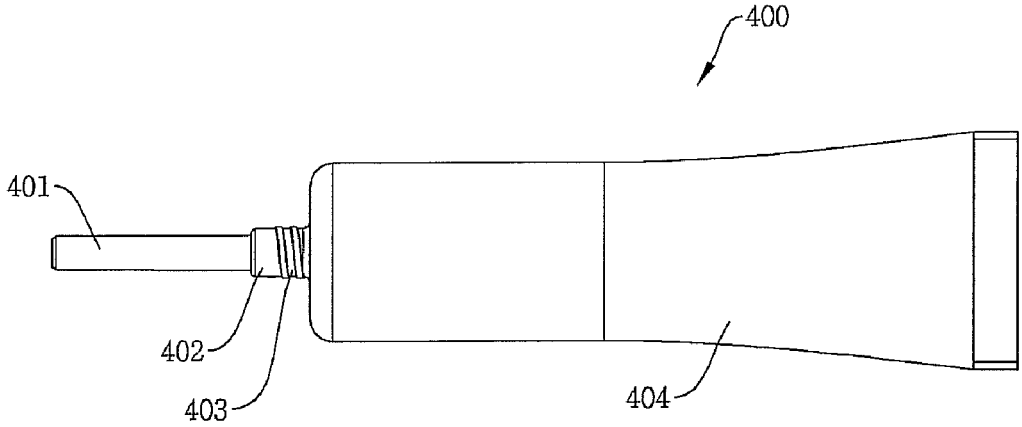
FIG. 7 is a plan view showing a tube of FIG. 3.
Figure 8A:
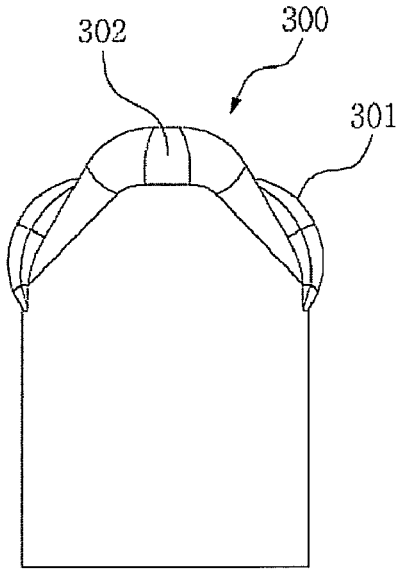
FIGS. 8A and 8B are a plan view showing a nozzle of FIG. 3 and a sectional view.
Figure 8B:
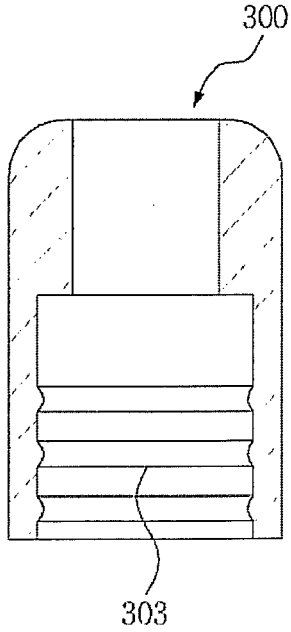
Figure 9A:
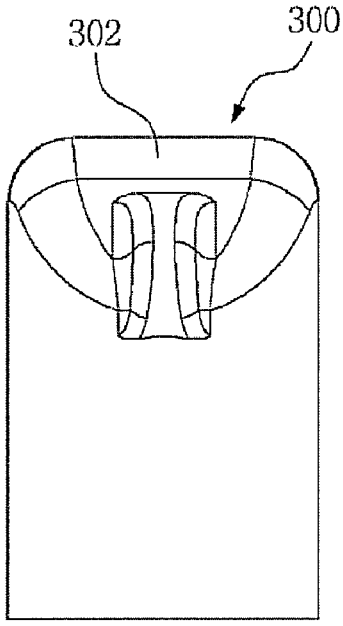
FIGS. 9A and 9B are a plan view showing the nozzle of FIG. 3 and a sectional view.
Figure 9B:
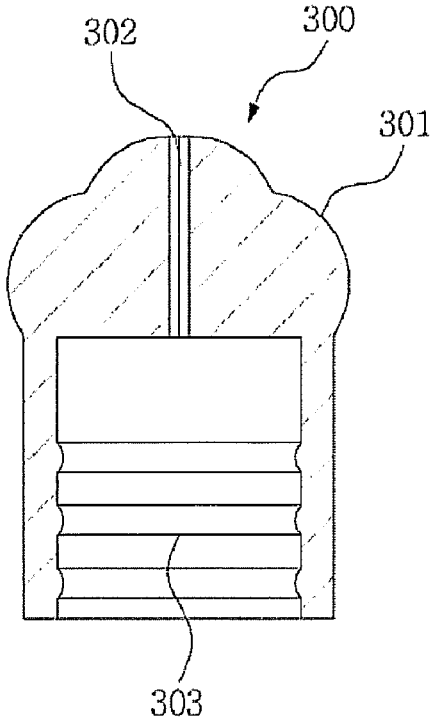

Further, FIG. 7 is a plan view showing a tube of FIG. 3, FIGS. 8A and 8B are a plan view showing a nozzle of FIG. 3 and a sectional view, and FIGS. 9A and 8B are a plan view showing the nozzle of FIG. 3 and a sectional view.

Figure 10A:
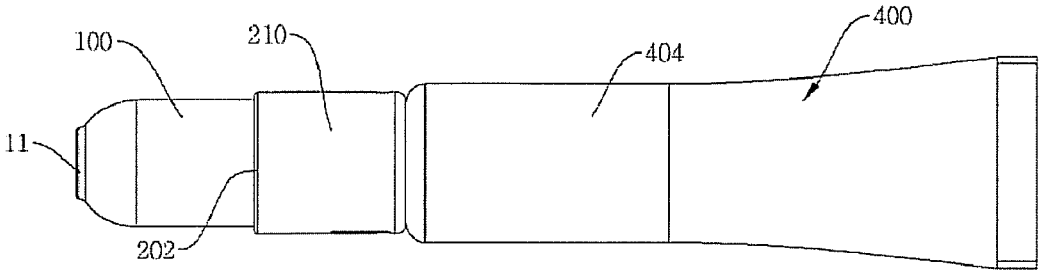
FIGS. 10A and 10B are a front view showing the assembled container of FIG. 3 in a closed state and a sectional view.
Figure 10B:
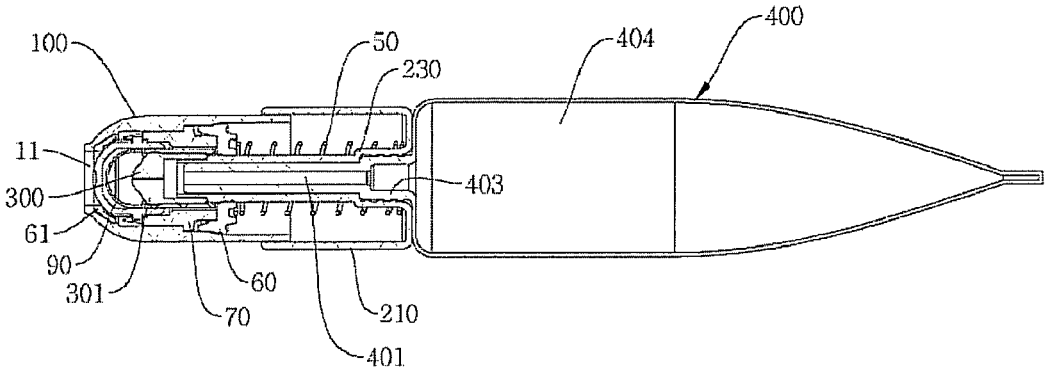
Figure 11A:
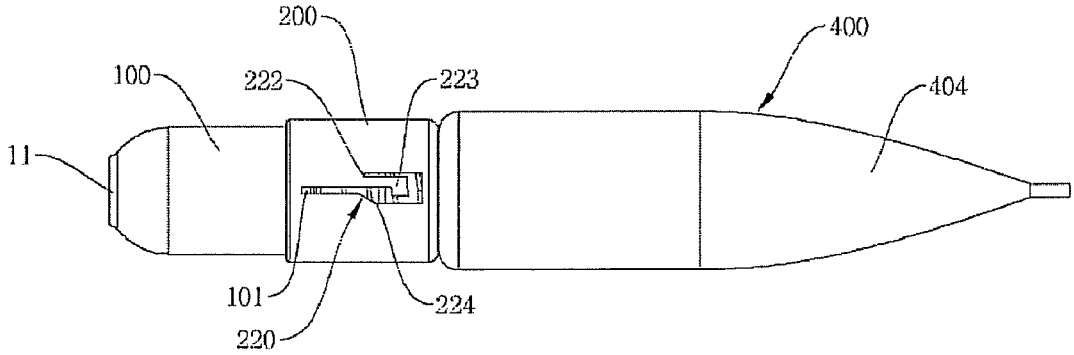
FIGS. 11A and 11B are a side view showing the assembled container of FIG. 3 in the closed state and a sectional view.
Figure 11B:
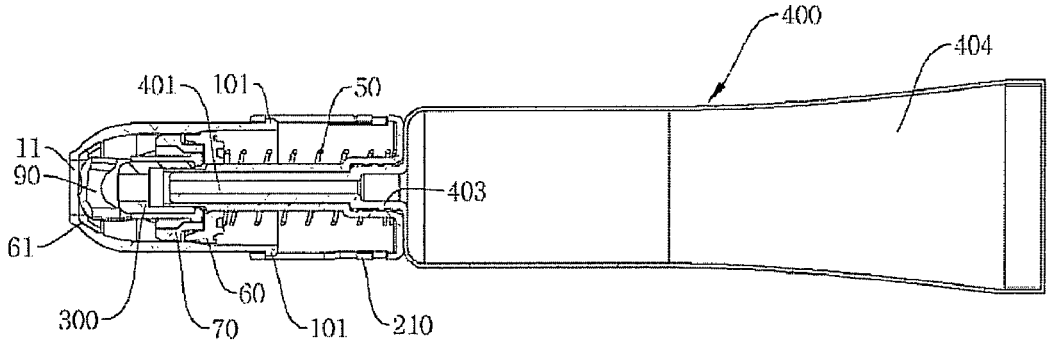
Figure 12A:
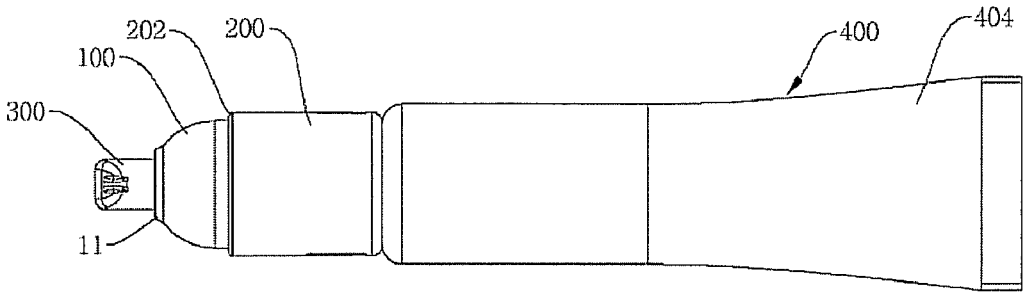
FIGS. 12A and 12B are a front view showing the assembled container of FIG. 3 in an open state and a sectional view.
Figure 12B:
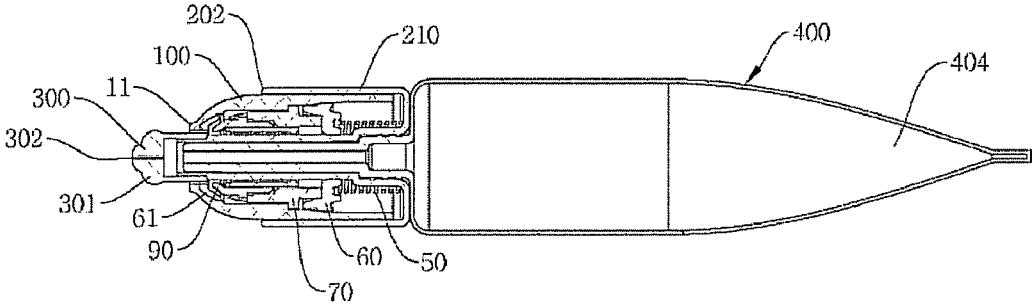
Figure 13A:
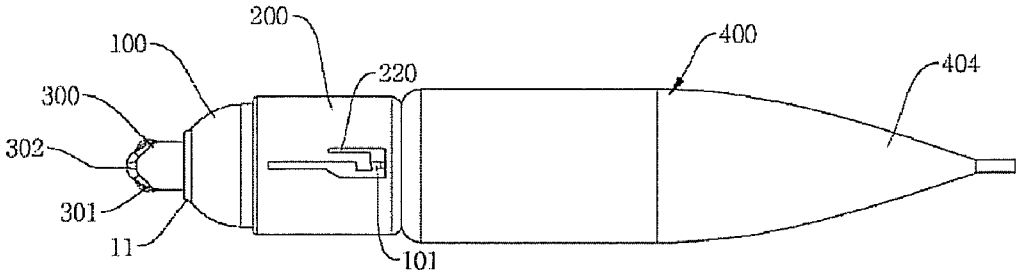
FIGS. 13A and 13B are a side view showing the assembled container of FIG. 3 in the open state and a sectional view.
Figure 13B:
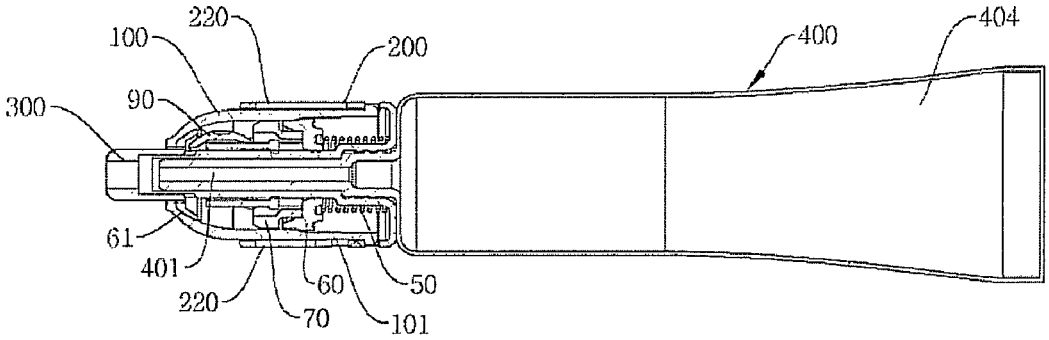

Further, FIGS. 10A and 10B are a front view showing the assembled container of FIG. 3 in a closed state and a sectional view, and FIGS. 11A and 11B are a side view showing the assembled container of FIG. 3 in the closed state and a sectional view. FIGS. 12A and 12B are a front view showing the assembled container of FIG. 3 in an open state and a sectional view, and FIGS. 13A and 13B are a side view showing the assembled container of FIG. 3 in the open state and a sectional view.

As shown in FIG. 3, a cap of a tube container of the present invention includes a cone 100, a body 200, a nozzle 300 and an anti-drying unit for opening or closing a discharge port.

The anti-drying unit includes a spring 50, packings 60 and 61, a holder 70, a link 80, a ball-type door 90, and packings interposed between the components. The anti-drying unit has the same construction as a device for air-tightly sealing a nozzle hole of a barrel, which is disclosed in Korean Patent No. 10-0817202 that was filed by the inventor of the present invention and is entitled 'a retractable writing instrument having an anti-drying unit'. The detailed description of the construction and mechanism of the device will be omitted herein.

The anti-drying unit includes the spring 50 which restores a cone 100 accommodated in the body 200 to its original position using elastic force. The packing 60 is slidably installed in the cone 100 to perform an airtight sealing operation. The holder 70 is seated in the cone 100 in such a way that an end of the holder 70 is axially inserted into the packing 60. The link 80 is slidably coupled to the interior of the holder 70. The ball-type door 90 is seated in the cone 100 in such a way that parallel pins of the link 80 are fitted into pin slits, so that the door 90 is rotated by a predetermined rotating angle in conjunction with the slidable rectilinear reciprocating motion of the link 80. The anti-drying unit functions to open or close the ball-type door 90.

That is, the anti-drying unit of the present invention is operated as follows. When a user holds the side surface of the cone 100 with two fingers in a pinch grip and then pushes the cone 100 towards the tube, the ball-type door 90 operated in conjunction with the cone 100 is rotated in an opening direction by the rotating angle of +90°. Thereby, the passage of the ball-type door 90 is aligned in the axial direction of the nozzle 300, and simultaneously a nozzle hole 11 of the cone 100 is opened.

Subsequently, the nozzle 300 is ejected out of the nozzle hole 11 through the passage of the ball-type door 90, so that contents are ready to be used.

In contrast, when a user holds the cone 100 and then slightly turns the cone 100 towards a guide slit, a locking protrusion of the cone 100 is removed from a locking step, so that the ball-type door 90 is rotated in a closing direction by the rotating angle of −90° by the elastic restoring force of the spring 50. Thus, the passage of the ball-type door 90 is perpendicular to the axial direction of the nozzle 300, and simultaneously the nozzle hole 11 of the cone 100 is closed. The ball-type door 90 is in contact with the packing 61 which is in close contact with the nozzle hole 11, and the ejected nozzle 300 is restored to its original position, that is, retracted into the cone 100.

Here, the direction in which the nozzle 300 is ejected is designated as the forward moving direction, while the opposite direction is designated as the backward moving direction.

Further, a side of the cone 100 having the nozzle hole 11 will be referred to as a front end or an upper end, while the opposite side will be referred to as a rear end or a lower end.

As shown in FIGS. 3 and 4, the cone 100 has the shape of a hollow pipe or tube.

The cone 100 may be produced by an injection molding process, such as a molding process using a plastic material. When the cone 100 is made of the plastic material, the cone 100 has one of the general properties of plastics, namely, elasticity, flexibility and extendibility.

The nozzle hole 11 is formed in a first end of the cone 100, while an insert hole 14 is formed in a second end of the cone 100 and has an inner diameter that is big enough for the following components to be inserted into the cone 100.

After the cone 100 is inserted into an insert hole 202 of the body 200, a user may axially reciprocate the cone 100 within a predetermined stroke range so that the nozzle 300 is ejected out of or retracted into the nozzle hole 11 of the cone 100 according to the above-mentioned retractable mechanism, and a stop operation may be temporarily performed at either end of the stroke.

To this end, the cone 100 has on opposite sides thereof a pair of locking protrusions 101.

The locking protrusions 101 are provided on the outer surface of the cone 100 to be caught by guide slits of the body 200 while the cone 100 moves linearly forwards and backwards.

As will be described below in detail, each locking protrusion 101 moves along the corresponding guide slit. The moving distance and direction of the locking protrusion 101 become the same as the moving distance and direction of the cone 100.

As shown in FIGS. 5 and 6, the body 200 includes a cap part 210 and a support pipe 230 which is provided in the cap part 210 to be located at a central position thereof.

A diameter of the cap part 210 is set such that the outer wall of the cone 100 is in close contact with the inner wall of the body 200. Thereby, the cap part 210 accommodates the cone 100 therein in such a way that the cone 100 moves in the cap part 210 in the longitudinal direction of the cap part 210.

The cap part 210 has guide slits 220 at opposite positions thereof to correspond to the locking protrusions 101, so that the locking protrusions 101 may move along the guide slits 220 while being restrained by the guide slits 220.

Each guide slit 220 includes a locking part 221 at a position around the insert hole 202 of the cap part 210. The guide slit 220 extends downwards from the locking part 221 in a vertical direction, and forms an inclined part 224 having a predetermined angle. Subsequently, the guide slit 220 extends downwards from the inclined part 224 in the vertical direction, extends in a horizontal direction, and then extends upwards in the vertical direction, thus forming an end 222.

Further, a locking step 223 is provided in a portion of the guide slit 220 between the inclined part 224 and the end 222, in the form of a free end having tension.

When the locking protrusion 101 moves downwards in the vertical direction from the locking part 221, the locking step 223 puts tension on the locking protrusion 101, thus rendering the locking protrusion 101 to be caught by a horizontal part without passing through the inclined part 224.

A first end of the cap part 210 is open at the insert hole 202 and a second end thereof is closed. Further, the support pipe 230 is connected to the inner surface of the cap part 210 in such a way as to be placed on the center thereof.

The support pipe 230 is a through pipe that is secured at opposite ends thereof to the tube 400 and the nozzle 300. The support pipe 230 serves as a pipe for moving contents from the tube 400.

The support pipe 230 is firmly secured at the first end thereof to the nozzle 300, and a support ring 231 is provided on the outer surface of the support pipe 230 to connect the support pipe 230 to the nozzle 300 in a watertight fashion.

Further, an internal thread 232 is formed on the inner surface of the second end of the support pipe 230 to be firmly fastened to a tube fastening screw that will be described below, thus making a watertight connection to the tube fastening screw.

The tube 400 includes a tube body 404 which contains contents, and a straw 401 which is connected to an injection port 402 of the tube body 404.

The tube body 404 is made of a metal or soft rubber material so that contents may be squeezed in the same manner as a general ointment tube.

A screw 403 is formed on the outer surface of the injection port 402 of the tube body 404 to engage with the internal thread 232 of the body 200.

The straw 401 has a diameter which is set to allow the straw 401 to be in close contact with the inner surface of the support pipe 230, and is inserted into the support pipe 230.

As shown in FIGS. 8A to 9B, the nozzle 300 is located at an end which is coupled to the support ring 231 provided on an end of the support pipe 23, and is made of an elastic material so that contents transmitted from the straw 401 are discharged through an open cut slit.

To this end, a support ring 303, which is formed to correspond to the support ring 231 of the body 200, is provided on the inner surface of the second end of the nozzle 300 to be coupled to the support ring 231.

The first end of the nozzle 300 is closed while forming a curved surface, and a cut slit 302 is formed in the central portion of the nozzle 300 in the shape of a straight line, so that the contents are discharged through the cut slit 302.

Push protrusions 301 are provided on opposite sides of the cut slit 302 on the curved first end of the nozzle 300.

In the closed state, the push protrusions 301 are accommodated in the link 80 of the anti-drying unit and protrude to be subjected to pressure from the inner wall of the link 80. Thus, when both the push protrusions 301 apply pressure to the curved first end, the open cut slit 302 becomes narrower to maintain watertightness.

FIGS. 10A and 10B are a front view showing the assembled container of FIG. 3 in the closed state and a sectional view, and FIGS. 11A and 11B are a side view showing the assembled container of FIG. 3 in the closed state and a sectional view.

As shown in the drawings, an end of the cone 100 is inserted into the insert hole 202 of the body 200 in such a way that each locking protrusion 101 of the cone 100 is caught by the locking part 221 of the body 200. In this case, the spring 50, the packing 60, the holder 70, the link 80, the ball-type door 90, and the packing 61 are positioned in a space defined by the cone 100 and the body 200 to be arranged sequentially from the second end of the body 200, corresponding to the bottom of the body 200, to the insert hole 11 of the cone 100.

That is, in the closed state, the second end of the body 200 is in contact with an end of the spring 50, and the insert hole 11 of the cone 100 is in close contact with the packing 61 which is in contact with the ball-type door 90.

Further, after the straw 401 is inserted into the support pipe 230 of the body 200, the internal thread 232 of the body 200 engages with the screw 403 of the tube 400, and the support ring 303 of the nozzle 300 is coupled to the support ring 231 of the support pipe 230.

Here, the spring 50 is interposed between the bottom of the body 200 and the packing 60 to impart elastic force. As the cone 100 is gradually increased into the body 200, larger elastic force is generated.

Thus, the ball-type door 90 of the anti-drying unit closes the nozzle hole 11 using the elastic force of the spring 50, and each locking protrusion 101 is caught by an end of the locking part 221.

In such a state, as shown in FIGS. 12A to 13B, if the cone 100 is inserted into the body 200 (or the cone 100 is fixed and the body 200 moves forwards to the cone 100), each locking protrusion 101 of the cone 100 moves linearly along the guide slit 220 and passes through the locking step 223 to be caught by the horizontal part.

As the locking protrusion 101 moves as such, the ball-type door 90 is rotated 90° to completely open the nozzle hole 11 according to the mechanism of the anti-drying unit, and the nozzle 300 connected to the support pipe 230 of the body 200 is ejected out of the nozzle hole 11.

Since the locking protrusion 101 is caught by the horizontal part, the cap part 210 or the body 200 does not move any more, and only the nozzle 300 is exposed to the outside of the nozzle hole 11. In such a state, if the tube 400 is squeezed, the contents in the tube move along the straw 401 and are discharged through the opened cut slit 302 of the nozzle 300.

In this case, the spring 50 is compressed, so that elastic force reaches a maximum.

Thus, if the cone 100 is slightly turned towards the guide slit when the elastic force of the spring 50 is at a maximum, the locking protrusion 101 caught by the horizontal part moves downwards along the guide slit in the vertical direction and then moves horizontally. Thereafter, the locking protrusion 101 is automatically moved upwards in the vertical direction by the elastic force, so that the locking protrusion 101 is caught by the locking part 221. By the movement of the locking protrusion 101, the ball-type door 90 is rotated 90° according to the mechanism of the anti-drying unit, thus closing the nozzle hole 11.

Further, the nozzle 300 connected to the support pipe 230 of the body 200 is retracted into the nozzle hole 11 to be positioned in the anti-drying unit, that is, to return to the position of FIGS. 10A and 10B or FIGS. 11A and 11B. The push protrusions 301 provided on both sides of the nozzle 300 are subjected to pressure from the inner wall of the holder 70, thus more tightly closing the cut slit 302.

As described above, the present invention provides a cap of a tube container having an automatic sealing structure, which more reliably performs an airtight function, prevents liquid ingredients in a nozzle from drying, and safely protects the nozzle in a physical way.

Further, the present invention provides a cap of a tube container having an automatic sealing structure, which prevents gel-phased medical ingredients from being in contact with the outside air to the maximum extent possible, thus allowing the medical ingredients to be preserved for a longer period of time, and which is constructed so that the cap is integrated with the container, thus eliminating the risk of loss resulting from the separation:

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cap of a tube container having an automatic sealing structure, comprising:

a cone having a shape of a hollow pipe, and including:

a nozzle hole formed in a first end of the cone to permit a nozzle to move in and out;

an insert hole formed in a second end of the cone; and a pair of locking protrusions provided on opposite sides of an outer surface of the cone and adjacent to the insert hole;

a body including:

a cap part comprising an integrated body which has on a first end thereof an insert hole to permit insertion of the cone, and has on a second end thereof a bottom;

a support pipe extending from a center of the bottom, passing through an interior of the cap part and protruding to an outside of the cap part; and a guide slit formed at a position corresponding to each of the locking protrusions, and movably restraining the locking protrusion;

a tube containing contents, and having on an injection port for discharging the contents a screw that engages with a thread provided on an end of the support pipe; and an anti-drying unit interposed between the body and the cone to air-tightly close the nozzle hole of the cone which moves forwards and backwards relative to the body.

2. The cap of a tube container as set forth in claim 1, wherein the cone, which is secured by each of the locking protrusions inserted into the guide slit, is inserted into the body as the locking protrusion moves, so that the nozzle hole is opened by the anti-drying unit and the contents are discharged through the ejected nozzle.

3. The cap of a tube container as set forth in claim 1, wherein support rings are provided, respectively, on an outer surface of an end of the support pipe and an inner surface of an end of the nozzle so that the support pipe is firmly secured to the nozzle.

4. The cap of a tube container as set forth in claim 1, wherein the guide slit formed in a side surface of the cap part comprises:

a locking part provided on a position of the guide slit adjacent to the insert hole of the cap part, and locking the locking protrusion under action of elastic force of the spring;

an inclined part extending downwards from a hole which extends downwards from the locking part in a vertical direction in such a way as to have an inclination angle;

an end formed at an end position of a hole which extends downwards from the inclined part in the vertical direction, forms a horizontal part, and then extends upwards in the vertical direction, and locking the locking protrusion under action of elastic force of the spring; and a locking step comprising a free end formed by the hole which extends downwards from the inclined part in the vertical direction, forms the horizontal part, and then extends upwards in the vertical direction.

5. The cap of a tube container as set forth in claim 1, wherein the tube further comprises a straw which extends from the injection port to be inserted into the support pipe and thus transmit the contents from the injection port to the nozzle.

6. The cap as set forth in claim 1, wherein the nozzle comprises a cut slit which is formed in a center of a curved surface of the nozzle in a shape of a straight line so as to discharge the contents, the cut slit being closed again by a restoring force of the nozzle made of an elastic material after the contents have been discharged.

7. The cap of a tube container as set forth in claim 6, wherein push protrusions are provided on opposite sides of the cut slit on the curved surface of the nozzle, so that both the push protrusions are subjected to pressure by an inner wall of the holder when the nozzle is accommodated in the anti-drying unit, thus more water-tightly closing the cut slit.

* * * * *